United States Patent [19]

Struthers et al.

[11] Patent Number: 4,778,134

[45] Date of Patent: Oct. 18, 1988

[54] SPEAKER WALL BRACKET

[75] Inventors: Scott Struthers, San Clemente; Kenneth H. Humphreys, Riverside, both of Calif.

[73] Assignee: Dana Innovations, San Juan Capistrano, Calif.

[21] Appl. No.: 87,509

[22] Filed: Aug. 20, 1987

[51] Int. Cl.[4] ..... G12B 9/00

[52] U.S. Cl. ..... 248/27.1; 248/27.3; 248/343; 248/DIG. 6

[58] Field of Search ..... 248/27.1, 27.3, 342, 248/343, 344, 205.1, DIG. 6

[56] References Cited

U.S. PATENT DOCUMENTS

| | | | |
|---|---|---|---|
| 3,327,984 | 6/1967 | Rennie | 248/343 |
| 3,369,784 | 2/1968 | Whitney | 248/27.1 |
| 3,664,615 | 5/1972 | Kruger | 248/27.1 |
| 3,666,040 | 5/1972 | Junk | 248/27.1 X |
| 4,250,540 | 2/1981 | Kristofek | 248/27.1 X |
| 4,444,369 | 4/1984 | Job | 248/27.1 |
| 4,614,374 | 9/1986 | Lannert et al. | 248/27.3 X |
| 4,673,149 | 6/1987 | Grote et al. | 248/27.1 X |
| 4,688,596 | 8/1987 | Liebmann et al. | 248/27.1 X |

*Primary Examiner*—Ramon O. Ramirez

*Attorney, Agent, or Firm*—Stetina and Brunda

[57] ABSTRACT

A speaker wall and ceiling mounting bracket comprising a housing to support and secure the speaker and thin support wings extending from the housing and fastened to the frame members of the wall and ceiling.

26 Claims, 4 Drawing Sheets

SPEAKER WALL BRACKET

FIELD OF THE INVENTION

The present invention is directed to a wall bracket for components. In particular, the invention is directed to a bracket for electrical components, such as speakers, for mounting components in the walls and ceilings of frame-and-wallboard rooms and offices. In one embodiment, the bracket is supported by the framing members, such as, rafters, joists, or studs. In a second embodiment, the bracket is supported by the wallboard.

BACKGROUND OF THE INVENTION

The demand for high-quality speakers has increased dramatically over the last 20 years. As a consequence, there is a large selection of high-quality speakers available on the market. Unfortunately, speakers are somewhat bulky and cumbersome. There has been a demand to mount speakers in the ceiling and in the wall. The mounting of high-quality speakers in the ceiling or in the wall of an expensive enterprise, since the brackets must be custom-made and, frequently, the wall must be made of greater depth to fit the speaker cone and magnet in the wall space.

It is an object of the present invention to provide a bracket for a high-quality speaker system that can be assembled into the wall when the wall is fabricated.

It is a further object of the present invention to provide a wall bracket that can be installed into an existing wall with minimum damage to the wall so that the wall does not have to be patched and repainted after installation of the speaker.

It is a further object of the present invention to provide a wall bracket that can be installed in a frame-and-wallboard construction with minimum distortion of the wallboard.

It is still a further object of the present invention to provide a wall bracket that is adjustable, to allow the installer to adjust the wall bracket so that the front face of the wall bracket will be flush with the exposed surface of the wallboard.

These and other objects of the present invention are described below in more detail.

SUMMARY OF THE INVENTION

The present invention is directed to a component wall support bracket in the walls and ceiling of frame-and-wallboard construction comprising:

(a) a quadrilateral housing having parallel longitudinal walls and parallel end walls connected at right angles to each other, the top or front edge of the walls defining a common plane;

(b) first and second thin planar support wings, each wing having front and back sides, each wing being adjustably attached to the outer sides of two of the parallel walls of said housing, each wing having two rows of parallel apertures on opposite sides of each wing extending perpendicularly from said first end to the opposing second end of the wing;

(c) attachment means engaging said wings and said housing to adjustably attach the wings to said housing so that the distance between the top edge of said walls and the front side of said wings can be adjusted to the thickness of the wallboard; and (d) a bracing element extending perpendicularly from the back side of each wing along a first end thereof, each bracing element having a height equivalent to at least one-half the height of said walls of said housing, the bracing means being adapted to be removably attached on the outer side of the walls of said housing.

Preferably, the wings are solid structures, that is, excepting the two rows of apertures, the wings are continuous, whole, planar structures from end to end and side to side.

The attachment means comprises at least two screws, the shanks of which extend through slots in said bracing element and engage the walls of a channel in the walls of said housing which are in register with said slots, the slots extending from the bottom edge of said bracing element towards the back side of the wing, the length of said slots and said channels being adapted so that the distance between the top edge of said walls and the top side of said wings can be adjusted to between about ¼ inch and about 1 inch. Said housing has at least one channel on each wall, opening to the outer side of each wall to receive said attachment means, the channel extending from the bottom edge of the wall towards the top edge and through the wall.

In the preferred embodiment of the present invention, the housing has planar gussets at each corner of the housing extending perpendicularly from the inner side of said walls. The plane of the gussets is preferably parallel to the top edges of the housing walls. Preferably, the walls are strengthened with longitudinal ribs extending from the inner side of the walls and connected to the adjoining gussets. Most preferably, a stiffening member extends downwardly to the bottom edges of the housing walls from the free edge of each gusset at a right angle thereto, each end of said stiffening member being secured to the inner side of the walls adjoining the gusset. Preferably, each of said planar gussets has an aperture or recessed footing for receiving and detachably securing attachment means, such as screws.

In an alternative embodiment of the invention, the housing has at least one metal tab extending upwardly from the top edge on each of the longitudinal walls. The metal tab is adapted to be bent at right angles to the wall to engage the top surface of the wallboard. Optionally, the bracket will have short wings to engage the bottom surface of the wallboard.

The present invention also comprises an improved component mounting system for ceiling and walls of frame-and-wallboard construction comprising:

(a) two parallel frame members having front surfaces lying substantially in a common plane;

(b) a component wall bracket secured to said frame members, the bracket comprising a quadrilateral housing having two longitudinal walls and two end walls connected at right angles and two thin planar wings extending outwardly from two of said parallel walls of the housing, the wings lying in a plane parallel to the plane defined by the top edge of the walls of said housing, said wings being adjustably attached to the frame members by attachment means;

(c) wallboard having a back surface and a front surface, said wallboard being attached to said frame members by attachment means, said wallboard having a bracket access hole, the walls of which are in proximity to the outer side of said housing's walls, the top edge of the walls of said housing being approximately flush with the front surface of said wallboard;

(d) a component having an interior frame member adapted to be received within and detachably fastened to said housing and an exterior frame member adapted to engage the front surface of said wallboard and mask the bracket access hole; and (e) removable fastening means to removably fasten said component to said housing, said component wall bracket and component, when fastened together, engaging the back surface of said wallboard with said wings and the front surface of said wallboard with said exterior frame.

The present invention further comprises an improved component mounting system for walls and ceilings of frame-and-wallboard construction comprising:

(a) wallboard having a back surface and a front surface, said wallboard having a bracket access hole adapted to receive said quadrilateral housing, the top edge of the walls of said housing being approximately flush with the front surface of said wallboard, said wallboard covering said wings so that the top surface of said wings is in contact with the back surface of said wallboard;

(b) a component wall bracket secured to said frame members, the bracket comprising a quadrilateral housing having two parallel longitudinal walls and two parallel end walls connected at right angles, the top edge of said walls lying in a common plane, said housing having a plurality of tabs extending upwardly from the top edge of at least two of the parallel walls, said tabs adapted to be bent outwardly at right angles from said housing to engage the front surface of said wallboard, two thin planar support wings extending outwardly from the outer surface of two of said parallel walls of the housing, the wings lying in a plane parallel to the plane defined by the top edge of said walls, said wings being adjustably attached to the frame members by attachment means;

(c) a component having an interior frame member adapted to be received within said housing and removably fastened thereto and an exterior frame member adapted to engage the front surface of said wallboard about said housing to mask said housing and said bracket access hole; and (d) fastening means to removably fasten said component to said housing, said component wall bracket and component, when fastened together, engaging the back surface of said wallboard with said wings and the front surface of said wallboard about said housing with said exterior frame and said tabs.

DETAILED DESCRIPTION OF THE INVENTION

Figure 1:
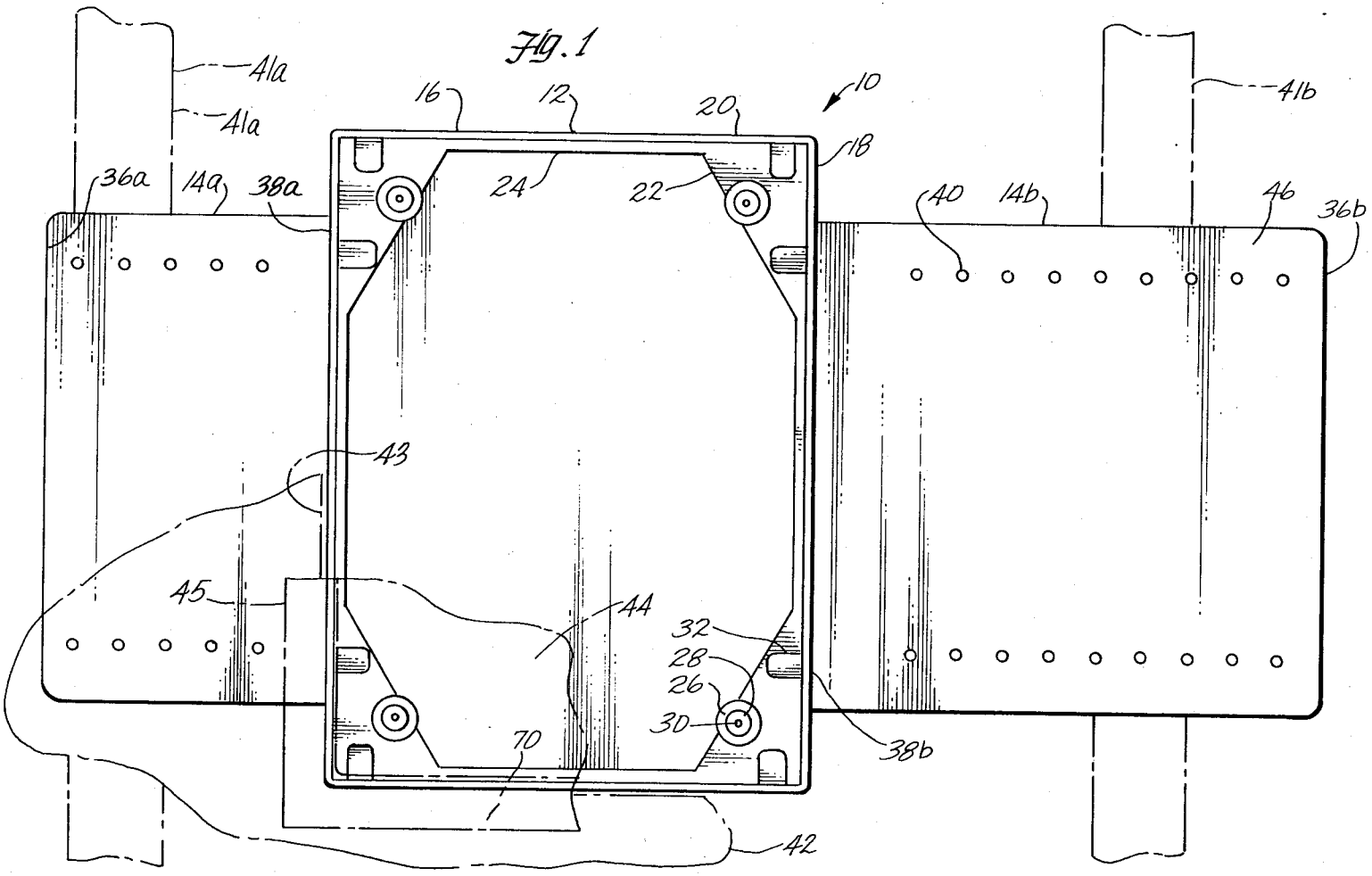
FIG. 1 is a top plan view of the wall support bracket of the present inventin shown mounted on a wall or ceiling.

Referring to FIG. 1, the component wall bracket 10 of the present invention comprises a housing 12 having side wings **14*a* and 14*b*. The housing has four walls 16, two parallel spaced-apart longitudinal walls 18, and two parallel spaced-apart end walls 20. The walls are joined at right angles. The housing is reinforced with planar gussets 22 at the corner of the housing which extend perpendicularly inwardly from the inner sides of the walls at each corner. The gussets are joined by ribs 24, which extend along and outwardly from the inner walls. Each gusset has a recessed footing 26 for receiving said supporting a pier, post, or foot of a component to be mounted in the component wall bracket. Each footing has a conical depression 28 in the middle thereof. The conical depression guides the screw to the screw hole, which ends in a screw hole 30. Extending inwardly from the inner side of the walls 16 into the gussets are channel bodies 32**, the function of which will be discussed below.

Each wing has an inner end 38 (**38*a* and 38*b*) which is positioned next to the outer side of a wall of the housing and an opposing outer end 36 (36*a* and 36*b*). Each wing also has two spaced-apart rows of holes 40 extending from the inner end to the outer end along the sides of the wings. The bracket of FIG. 1 has a short wing 14*a* and a long wing 14*b***. This bracket is particularly suited for walls and ceilings with frame members on 16-inch centers. The bracket can be mounted next to one frame member, halfway between the members, or at any position in between.

In FIG. 1, the component wall bracket is illustrated as being supported on two frame members, that is, studs, joists, or rafters, **41*a* and 41*b*. Preferably, the bracket is installed on the wall before installation of the wallboard. The bracket is conveniently nailed onto the frame members 41*a* and 41*b* through holes 40. The width of the housing and the wings is adjusted so that the bracket can be mounted on frame members with ½ inch to 19 inch centers. By replacing wing 14*a* with a 14*b* wing, the bracket can be mounted on frame members having about 11 inch to about ½-inch centers. The frames are not notched to receive the wing. Accordingly, the wings extend above the front surface of the frames by the thickness of the wings. To prevent the bulging of the wallboard 42 covering the wings, the wings are thin, that is, a thickness of 1/16-inch or less. If the thickness of the wings exceeds 1/16-inch, the wallboard will noticeably bulge around the wing area. After the bracket is mounted and fastened to the frame members 41*a* and 41*b*, the wallboard is cut to size and applied to the frame members. A bracket access hole 43 is cut of the wallboard before installation to receive the top or the face of the housing. Preferably, before the wallboard is applied, the wall is wired for the component to be received within the bracket. After the wallboard has been secured to the frame member, the component can be installed in the housing. Preferably, however, preparation and painting of the wallboard will be completed before installation of the component. Preferably, the component will have an exterior frame 44 of an ornamental design to have a pleasing esthetic look. The outer periphery of the exterior frame 44 will extend beyond the housing and the bracket access hole 43, so that the exterior frame will mask the housing as well as the access hole. (See also FIG. 3**.)

Figure 2:
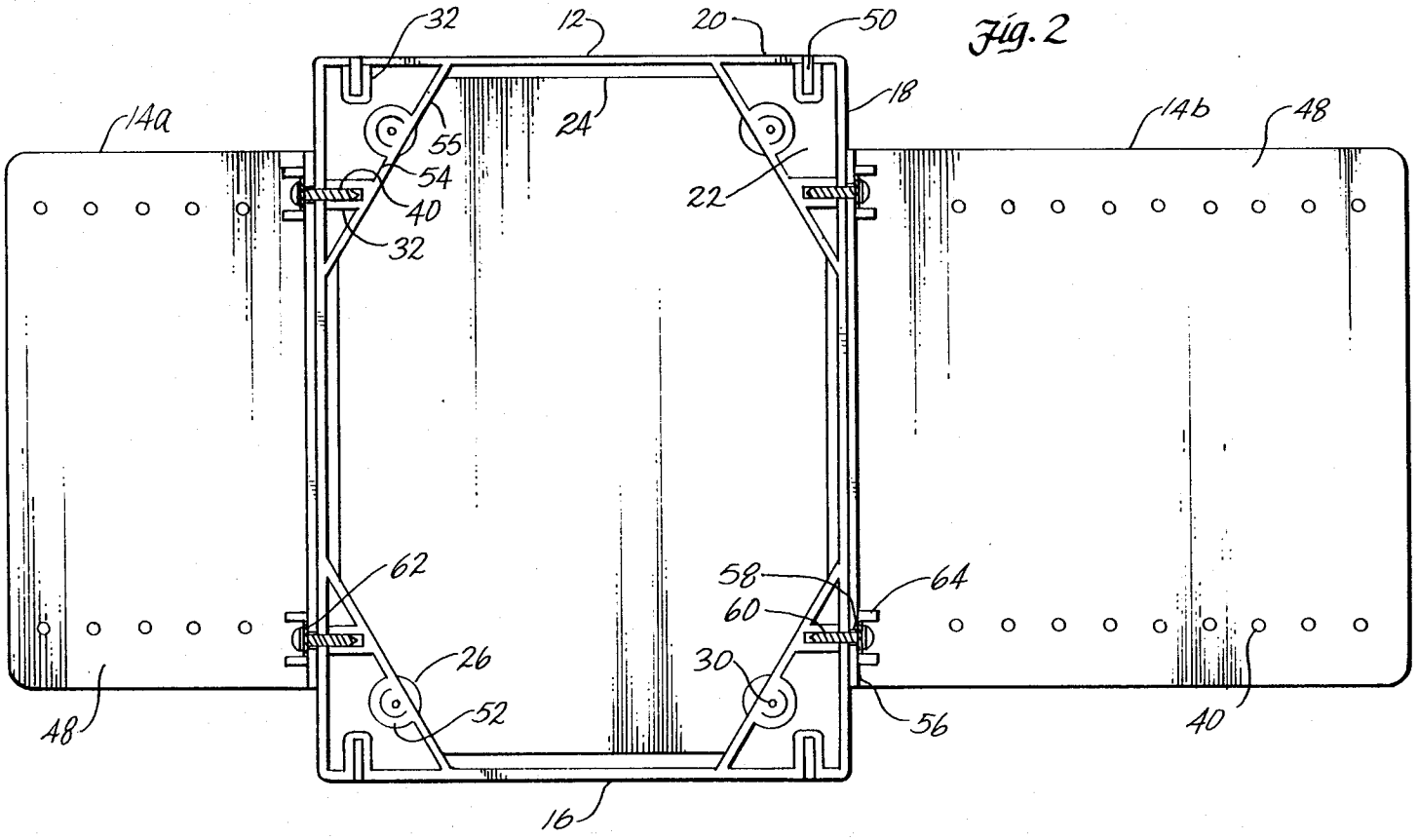
FIG. 2 is a bottom plan view of the wall support bracket of the present invention.
Figure 3:
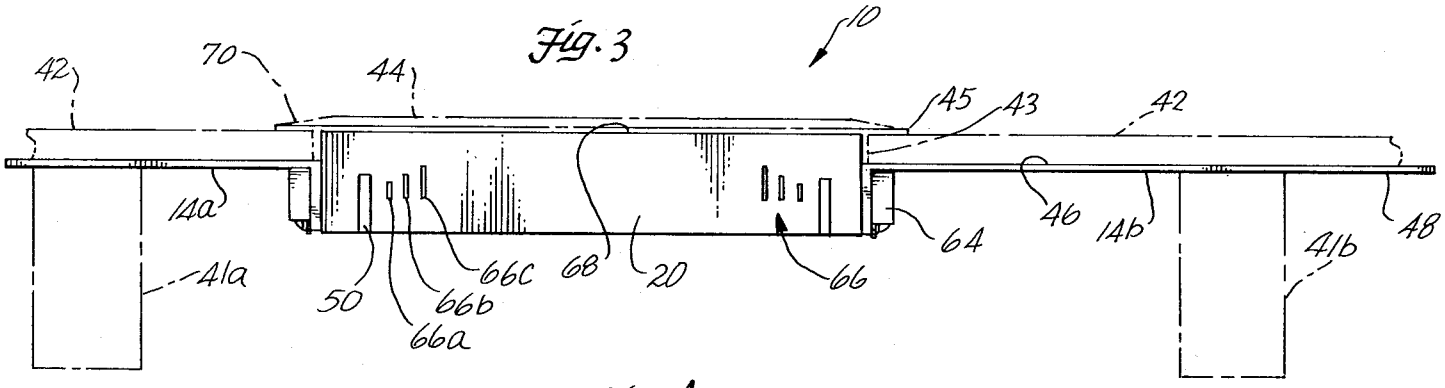
FIG. 3 is an end plan view of the wall support bracket of the present invention shown mounted on a wall or ceiling.

Referring to FIG. 2, the bottom of the component wall bracket is shown, illustrating the bottom sides 48 of the wings 14*a* and 14*b* and the bottom structure of the housing 12. The channel housing 32 surrounds a channel 50 which is open to the bottom side of the housing and to the side of the housing through the walls 16. As can be seen in FIG. 3, the channel openings extend from the bottom edge of the walls towards the top edge of the walls. The channels are adapted to receive machine screws 60 for adjustably securing the wings to the housing. The underside portion 52 of the recessed footing 26 extends from the gusset to the bottom plane of the housing, that is, the plane defined by the bottom edge of the walls 16. Each gusset has a bracing member 54 extending at each corner from one wall to the other and mating with the inner edge 55 of the gusset.

Each wing has a bracing element 56 located at the inner side (38*a* or 38*b*) of the wing and extending downwardly from the bottom side 48 of the wing. Each bracing element has two elongated slots 58 which are in register with the two channels 50 in the walls so that the wings can be mounted with screws along the longitudinal wall 18 or the end walls 20 of the housing. The wings are secured to the housing by screwing machine screws 60 through the slots into the channels. The screws can be fitted with lock washers 62. To strengthen the slots and the bracing element with relation to the wings, the wings are fitted with rectangular rib braces 64 extending outwardly from the rib braces on both sides of each slot. The rib braces extend downwardly from the back side of the wings substantially the full length of the bracing element.

FIG. 3 illustrates the component wall brace, from an end, mounted in the wall covered with wallboard and fitted with the component. The wings 14*a* and 14*b* are mounted by screws, nails, or staples (not shown) to frame members 41*a* and 41*b*, respectively. Wallboard 42 is secured to the frame members in the usual manner and covers the wings 14*a* and 14*b*. The wallboard has a component bracket access hole 43 cut out to receive the top portion of the housing. When the component wall bracket is installed, the installer loosens screw 60 and adjusts the distance between the top side 46 of the wings and the top edge 68 of the walls 16 to the thickness of the wallboard 42. Thus, when the wallboard is installed on the frame members, the top edge 68 of the housing will be flush with the exposed surface of the wallboard and will not extend beyond the exposed surface of the wallboard. Each wall of the housing (not shown on walls 18) has distance indicators 66 which the installer can use to adjust the wings of the housing. If the wallboard is ¾-inch thick, the top side 46 of the wings is adjusted to be in line with the top of indicator 66*a*; if the wallboard is ⅝ inch thick, the top side of the wings is adjusted to be in line with the top of indicator 66*b*; and if the wallboard is ½-inch thick, the top side of the wing is adjusted to be in line with the top of indicator 66*c*. When a component is installed in the bracket, the exterior frame 44 of the component extends beyond the housing and beyond the periphery of the bracket access hole 43, thus hiding both the housing and the hole. The component is normally screwed into the bracket, thus forming a composite structure wherein the wallboard 42 is sandwiched between the wings 14 and the overlapping portion 70 of the exterior frame 44.

The component wall bracket is illustrated with the wings extending from the longitudinal walls 18 of the housing. Optionally, the wings can be fitted on the end walls 20 in the same manner as they are fitted on the longitudinal walls. The end walls have the same channels 51 for receiving machine screws 60. The wings can be fitted on end walls or longitudinal walls to accomplish a particular orientation of the bracket and component in a wall or a ceiling.

Figure 4:
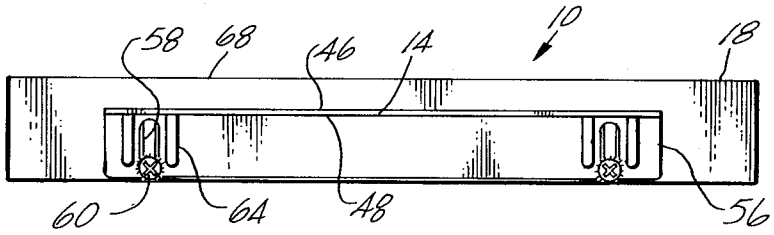
FIG. 4 is a side plan view of the wall support bracket of the present invention.

Referring to FIG. 4, the side of the component wall bracket is illustrated, showing the thin wings 14 from the side and the bracing element 56. The slots 58 extend from the bottom edge of the bracing element towards the bottom side 48 of the wings. In FIG. 4, the screws 60 are shown positioned near the bottom of the channels 50. This permits the wings to be lowered with respect to the housing in order that the distance between the top edge of the housing 68 and the top side 46 of the wings can be about one inch. If the bracket is to be installed on a wall having very thin wallboard material, such as ⅛-inch veneer, the screws can be inserted further up the channel, thus permitting the wings to be adjusted upwardly towards the top edge of the housing.

Figure 5:
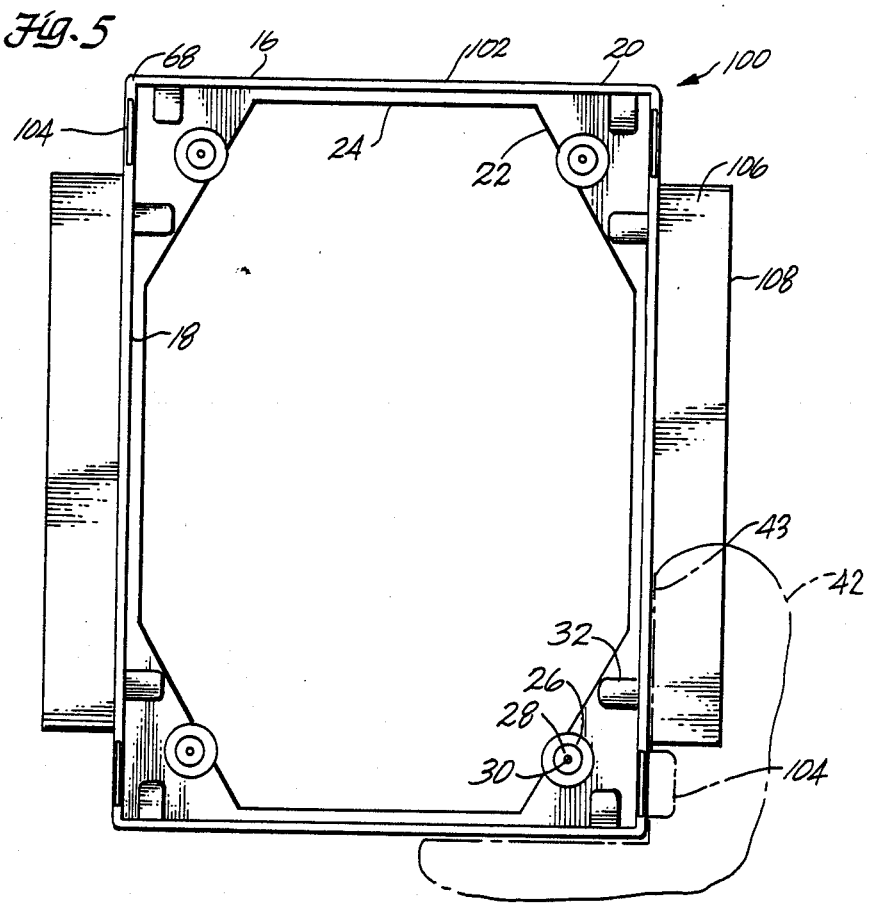
FIG. 5 is a top plan view of another embodiment of the wall support bracket of the present invention shown mounted in a wall or ceiling.

FIG. 5 illustrates an alternative embodiment of the component wall bracket 100 of the present invention. This bracket can be conveniently installed in an existing frame-and-wallboard ceiling or wall. With one exception, the housing is of the same construction as housing 12 described above. The housing 102 has walls 16 comprising longitudinal walls 18 and end walls 20. The corners of the walls are strengthened by internal gussets 12 which are joined together by ribs 24 which extend from the gussets and from the inner side of the walls. The walls have channel bodies 32 surrounding channels 50 and recessed footings 26. The center of the footings has a conical depression 28 and a central hole 30 for receiving screws or other fastening devices. The housing also includes metal tabs 104 which extend upwardly from the upper edge of the walls. The tabs are adapted to be bent 90 degrees outwardly from the housing to engage the top surface of the wallboard 42 as shown in phantom in the lower right-hand corner of the figure.

Figure 6:
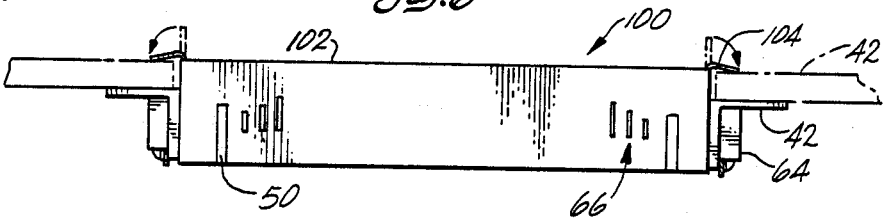
FIG. 6 is an end plan view of the wall support bracket of FIG. 5 shown mounted in a wall or ceiling.
Figure 7:
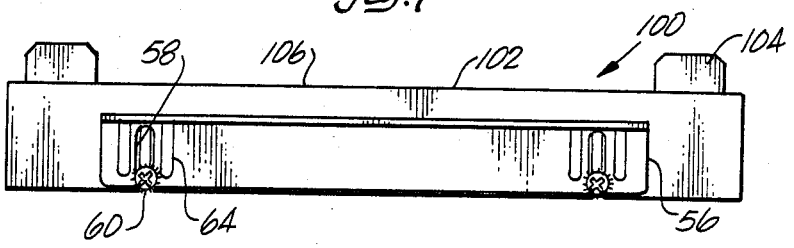
FIG. 7 is a side plan view of the wall support bracket of FIG. 5.

Referring to FIG. 6, tabs 104 of the housing 102 are shown bent over, engaging the front surface of wallboard 42. The wallboard is sandwiched between the short wings 106 and tabs 104. The wings 106 are of a similar construction to the wings 14 described above. However, wings 106 are much shorter than wings 14 and are not perforated. Wings 106 have a bracing element 56, a slot 58 adapted to receive a screw 60 which is threaded into channels 50 in the housing 102. The wing and bracing element 56 are strengthened by rib braces 64.

The component wall bracket 100 is used to install a component into an existing frame-and-wallboard wall. A bracket access hole 43, slightly larger than the length and width of the housing, is made in the existing wallboard 42. (See FIGS. 5 and 6.) The width of the bracket 100 is less than the length, and thus the bracket is inserted into the hole, small end first, with the outer edges of the wings facing the narrow side of the hole. Once the bracket is within the wall, it is rotated 90 degrees, and the housing is pulled into the hole, with the periphery of the hole and the walls of the housing being in their proper orientation. The wings 106 will engage the inner surface of the wallboard and prevent the housing from being pulled out through the hole. The metal tabs 104 are then bent at right angles outwardly from the housing to engage the top surface of the wallboard and secure the bracket to the wallboard. The length of the bracket and the overlap portion 70 of the exterior frame 44 of the component are adjusted so that the overlap portion 70 will mask the tabs 104 as well as the periphery of the access hole 43.

The wings 106 of the wall component bracket 100 can be adjusted in the same manner as the wings of the wall component bracket 10, that is, the screw 60 can be loosened, and the wings 106 can be adjusted along slots 58 to adjust the distance between the top of the wings 106 and the top edge of the housing.

The wall bracket of the present invention can be installed in all types of hollow frame and sheathed-construction ceilings and walls. It can be installed on a traditional frame-and-wallboard structure wherein the studs are normally two-by-fours and the ceiling rafters are one-by-sixes or larger. Additionally, the brackets can be installed in office buildings or in hospitals wherein the studs are normally sheet-metal studs and attachments are made to the studs by the use of machine screws. In frame-and-wallboard construction, the ceilings and walls are normally finished off with gypsum board or drywall, which will vary in thickness, depending on the fire code and the noise-dampening effect desired for the wall. However, the brackets can also be installed on ceilings and walls of frame construction sheathed or finished in veneer, plywood, particle board, formica-type materials, and lath-and-plaster.

What is claimed is:

1. A component wall bracket for walls and ceilings of frame-and-wallboard construction comprising:

(a) a quadrilateral housing having parallel longitudinal walls and parallel end walls, said end walls being connected to the longitudinal walls at right angles, the top edge of said walls defining a common plane;

(b) first and second thin planar support wings adapted to be attached to wall and ceiling framing, said wings having front and back sides, each wing being adjustably attached to the outer side of two of the parallel walls of said housing, said wings having bracing elements extending perpendicularly from the back side of each wing along a first end thereof, each bracing element having a height at least equivalent to one-half the height of said walls of said housing, each bracing element adapted to be attached to the outer side of one of said parallel walls, each wing having two rows of parallel apertures on opposite sides of each wing extending perpendicularly from said first end to the opposing second end of the wing;

(c) attachment means engaging said bracing element to adjustably attach the wings to said housing so that the distance between the top edge of said walls and the front side of said wings can be adjusted to the thickness of the wallboard; and (d) support means on said housing for supporting and securing a component to the bracket.

2. The bracket according to claim 1 wherein the attachment means comprises at least two screws, the shanks of which extend through slots in said bracing elements and engage the walls of a channel in said walls of said housing in register with said slots, the slots extending from the bottom edge of said bracing elements towards the back side of said wing, the length of said slots and said channels being adapted so that the distance between the top edge of said walls and the front side of said wings can be adjusted between about ⅛-inch and 1 inch.

3. The bracket according to claim 1 wherein each corner of said quadrilateral housing has a planar gusset extending perpendicularly from the inner side of adjoining walls and longitudinal ribs extending inwardly from the inner side of each wall and longitudinally extending to adjoining gussets, and a bracing member extending downwardly at a right angle from the free edge of each gusset, each end of said bracing member being secured to the walls adjoining the gusset.

4. The bracket according to claim 2 wherein each wall of said housing has at least two channels adapted to receive screws for fastening the wings to said housing, each of said channels extending from the bottom edge of the wall towards the top edge of the wall and extending through the wall.

5. The component wall housing according to claim 4 wherein each channel extends through the wall into a channel housing to receive the shank of a screw.

6. The bracket according to claim 1 wherein each of said planar gussets has a recessed footing for receiving and detachably securing the component, and fastening means for detachably securing the component to the bracket.

7. The bracket according to claim 1 wherein the thickness of each wing is no greater than 1/16".

8. A component wall bracket for walls and ceilings of frame-and-wallboard construction comprising:

(a) a quadrilateral housing having parallel longitudinal walls and parallel end walls, the end walls being connected to the longitudinal walls at right angles, the top edges of said walls defining a common plane;

(b) first and second thin planar support wings adapted to engage the back surface of wallboard, said wings having front and back sides, each wing being adjustably attached to the outer side of two of the parallel walls of said housing, said wings having bracing elements extending perpendicularly from the back side of each wing along a first end thereof, each bracing element having a height equivalent to at least one-half the height of said walls of said housing, each bracing element adapted to be attached to the outer side of one of said parallel walls of said housing;

(c) attachment means engaging said bracing element to adjustably attach the wings to said housing so that the distance between the top edge of said walls and the front side of said wings can be adjusted to the thickness of the wallboard; and (d) supporting means on said housing for supporting and securing a component to the bracket.

9. The bracket according to claim 8 wherein the attachment means comprises at least two screws, the shanks of which extend through slots in said bracing elements and engage the walls of a channel in said walls of said housing in register with said slots, the slots extending from the bottom edge of said bracing elements towards the back side of said wings, the length of said slots and said channels being adapted so that the distance between the top edge of said walls and the front side of said wings can be adjusted between about ⅛-inch and 1 inch.

10. The bracket according to claim 8 wherein each corner of said quadrilateral housing has a planar gusset extending perpendicularly from the inner side of adjoining walls and longitudinal ribs extending outwardly from the inner side of each wall and longitudinally extending to adjoining gussets, and a bracing member extending downwardly at a right angle from the free edge of each gusset, each end of said bracing member being secured to the walls adjoining the gusset.

11. The bracket according to claim 9 wherein each wall of said housing has at least two channels adapted to receive screws for fastening the wings to said housing, each of said channels extending from the bottom edge of the wall towards the top edge of the wall and extending through the wall.

12. The component wall housing according to claim 11 wherein each channel extends through the wall into a channel housing to receive the shank of a screw.

13. The bracket according to claim 8 wherein each of said planar gussets has a recessed footing for receiving and detachably securing the component, and fastening means for detachably securing the component to the bracket.

14. The bracket according to claim 8 wherein the thickness of each wing is no greater than 1/16".

15. An improved component mounting system for walls and ceilings of frame-and-wallboard construction comprising:

(a) two parallel frame members having front surfaces lying substantially in a common plane;

(b) a component wall bracket secured to said frame members, the bracket comprising a quadrilateral housing having two parallel longitudinal walls and two parallel end walls connected at right angles, the top edge of said walls lying in a common plane, two thin planar support wings extending outwardly from the outer surface of two of said parallel walls of the housing, the wings lying in a common plane parallel to the plane defined by the top edge of said walls, said wings being adjustably attached to the frame members by attachment means;

(c) wallboard having a back surface and a front surface, said wallboard being attached to the frame members by attachment means, said wallboard having a bracket access hole large enough to receive the front portion of said quadrilateral housing, the top edge of the walls of said housing being approximately flush with the front surface of said wallboard, said wallboard covering said wings so that the top surface of said wings is in contact with the back surface of said wallboard;

(d) a component having an interior frame member adapted to be received within said housing secured thereto and an exterior frame member adapted to engage the front surface of said wallboard about said housing to mask said housing and said bracket access hole; and (e) fastening means to removably fasten said component to said housing, said component wall bracket and component, when fastened together, engaging the back surface of said wallboard with said wings and the front surface of said wallboard about said housing with said exterior frame.

16. The mounting system according to claim 15 wherein the attachment means comprises each wing having a bracing element extending perpendicularly from one side of each wing along the end next to the outer surface of said parallel walls, each bracing element adapted to be adjustably attached to the outer side of one of said parallel walls and having a height equivalent to at least one-half the height of said walls of said housing.

17. The component mounting system according to claim 15 wherein the thickness of each wing is no greater than 1/16".

18. The bracket according to claim 15 wherein each corner of said quadrilateral housing has a planar gusset extending perpendicularly from the inner side of adjoining walls, longitudinal ribs extending inwardly from the inner side of each wall and longitudinally extending to adjoining gussets, and a bracing member extending downwardly at a right angle from the free edge of each gusset, each end of said bracing members being secured to the walls adjoining the gusset.

19. The bracket according to claim 18 wherein each wall of said housing has at least two channels adapted to receive screws, each bracing element of each wing having two slots coaxial with two channels of each wall adapted to receive screws for fastening the wings to said housing, each of said channels extending from the bottom edge of the wall towards the top edge of the wall and extending through the wall.

20. The bracket according to claim 19 wherein each wing is attached to the housing by at least two screws, the shanks of which extend through the slots in said bracing elements and the threaded portion of which engages the walls of said channel in said walls of said housing in register with said slots, the slots extending from the bottom edge of said bracing elements towards the back side of said wings, the length of said slots and said channels being adapted so that the distance between the top edge of said walls and the front side of said wings can be adjusted between about ⅛-inch and 1 inch.

21. The mounting system according to claim 14 wherein the attachment means comprises each wing having a bracing element extending perpendicularly from one side of each wing along the end next to the outer surface of said parallel walls, each bracing element adapted to be adjustably attached to the outer side of one of said parallel walls and having a height equivalent to at least one-half the height of said walls of said housing.

22. The component mounting system according to claim 14 wherein the thickness of each wing is no greater than 1/16".

23. The bracket according to claim 14 wherein each corner of said quadrilateral housing has a planar gusset extending perpendicularly from the inner side of adjoining walls, longitudinal ribs extending outwardly from the inner side of each wall and longitudinally extending to adjoining gussets, and a bracing member extending downwardly at a right angle from the free edge of each gusset, each end of said bracing member being secured to the walls adjoining the gusset.

24. The bracket according to claim 23 wherein each wall of said housing has at least two channels adapted to receive screws, each bracing element of each wing having two slots coaxial with two channels of each wall adapted to receive screws for fastening the wings to said housing, each of said channels extending from the bottom edge of the wall towards the top edge of the wall and extending through the wall.

25. The bracket according to claim 24 wherein each wing is attached to the housing by at least two screws, the shanks of which extend through the slots in said bracing elements and the threaded portion of which engages the walls of said channel in said walls of said housing in register with said slots, the slots extending from the bottom edge of said bracing elements towards the back side of said wings, the length of said slots and said channels being adapted so that the distance between the top edge of said wall and the front side of said wings can be adjusted between about ⅛-inch and 1 inch.

26. An improved component mounting system for walls and ceilings of frame-and-wallboard construction comprising:

(a) wallboard having a back surface and a front surface, said wallboard having a bracket access hole adapted to receive a component wall bracket;

(b) a component wall bracket secured to said wallboard, the bracket comprising a quadrilateral housing having two parallel longitudinal walls and two parallel end walls connected at right angles, the top edge of said walls lying in a common plane, said housing having a plurality of the taps extending upwardly from the top edge of at least two of the parallel walls, said tabs adapted to be bent outwardly at right angles from said housing to engage the front surface of said wallboard, two thin planar support wings extending outwardly from the outer surface of two of said parallel walls of the housing, the wings lying in a plane parallel to the plane defined by the top edge of said walls, said wings being adjustably attached to the frame members by attachment means, the top edge of the walls of said housing being approximately flush with the front surface of said wallboard, said wallboard covering said wings so that the top surface of said wings is in contact with the back surface of said wallboard;

(c) a component having an interior frame member adapted to be received within said housing and removably fastened thereto and an exterior frame member adapted to engage the front surface of said wallboard about said housing to mask said housing and said bracket access hole; and (d) fastening means to removably fasten said component to said housing, said component wall bracket and component, when fastened together, engaging the back surface of said wallboard with said wings and the front surface of said wallboard about said housing with said exterior frame and said tabs.

* * * * *

UNITED STATES PATENT AND TRADEMARK OFFICE

CERTIFICATE OF CORRECTION

PATENT NO. : 4,778,134

DATED : October 18, 1988

INVENTOR(S) : Struthers, et al.

It is certified that error appears in the above—identified patent and that said Letters Patent is hereby corrected as shown below:

Column 10, line 33, change "14" to --26--

Column 10, line 43, change "14" to --26--

Column 10, line 45, change "14" to --26--

Column 11, line 16, change "taps" to --tabs--

Signed and Sealed this

Ninth Day of October, 1990

*Attest:*

HARRY F. MANBECK, JR.

*Attesting Officer*

*Commissioner of Patents and Trademarks*